United States Patent [19]

Hanafusa et al.

[11] Patent Number: 4,913,305

[45] Date of Patent: Apr. 3, 1990

[54] BEVERAGE CONTAINER WITH BIFURCATED DISPENSING LID

[76] Inventors: Hisao Hanafusa, 20 Confucuis Plz. 34F, New York, N.Y. 10002; Nobu Fukui, 141 W. 26th St., New York, N.Y. 10001

[21] Appl. No.: 315,989

[22] Filed: Feb. 27, 1989

[51] Int. Cl.[4] ..... B65D 41/32

[52] U.S. Cl. ..... 220/269

[58] Field of Search ..... 220/269, 268, 90.4; 222/541; 215/235

[56] References Cited

U.S. PATENT DOCUMENTS

| | | | |
|---|---|---|---|
| 1,715,169 | 5/1929 | McKee | 222/541 |
| 1,878,677 | 9/1932 | Curtis | 220/269 |
| 2,950,833 | 8/1960 | Short | 215/235 |
| 4,014,455 | 3/1977 | LaCroce | 220/269 |
| 4,210,257 | 7/1980 | Radtke | 220/269 |
| 4,253,582 | 3/1981 | Shields | 220/269 |

*Primary Examiner*—Donald F. Norton

*Attorney, Agent, or Firm*—Salzman & Levy

[57] ABSTRACT

The invention features a beverage container having a large, semi-circular liquid dispensing opening. The opening is operatively caused to be unsealed by the action of a finger tab.

4 Claims, 1 Drawing Sheet

BEVERAGE CONTAINER WITH BIFURCATED DISPENSING LID

FIELD OF THE INVENTION

The invention relates to beverage containers having a sealed opening which is ruptured by the pulling of a tab disposed upon the lid, and more particularly to a beverage container having a semi-circular, tab-rupturable opening for dispensing the beverage at a greater flow rate.

BACKGROUND OF THE INVENTION

The aluminum beverage can in commercial use at the present time, features a small, elliptical, sealed opening that is ruptured when a tab is pulled upwardly from the lid.

Such a beverage container opening works well with the use of a straw, which is easily capable of withdrawing a sufficient amount of the beverage from the can.

However, the small elliptical opening does not provide for a smooth fluid flow, when the can is inverted in a pour-like mode. Because of its small size, the elliptical opening gives a surging or restricted flow, since the outside air which needs to enter the can during the outward flow of beverage, competes for the small space provided by the elliptical opening.

For those individuals who drink directly from the lid of the container, such flow is often accompanied by the effects of dribbling.

In addition, the small size of this type of opening makes it difficult to remove the last drops of fluid from the container.

Another undesirable feature of this type of can dispensing system is the tab, which easily breaks away from the lid. This break-away tab is a constant source of environmental pollution, since it is tossed away and has littered the country-side. Because the tabs are aluminum, they do not degrade, and have become a blighted eye-sore in the environment.

The present invention seeks to overcome the disadvantage of the current beverage container by providing a greater opening in the can, wherein one-half of the entire lid is partially removable. The greater area of the opening offers the user an unrestricted dispensing flow rate.

In addition, the current invention also features a recess in the top of the can for capturing a partially removed lid. In this way, when the can is discarded, there is no residual tabs which pollute the environment.

SUMMARY OF THE INVENTION

The invention pertains to a beverage container having a hollow tubular member for storing and dispensing a beverage.

A generally flat-surfaced, bifurcated lid is disposed on top of the tubular member.

The lid is partially removable from the tubular member by means of tearing the lid along a semi-circular scored line disposed about its periphery.

A tab secured to the lid and adjacently attached to the scored line, causes a rupturing of the scored line upon an initial pulling thereof. The lid will be torn and bent backwardly from the tubular member upon a further pulling of the tab.

The greater opening affords the user an unrestricted flow dispensing of the liquid of the container.

One of the many advantages of the invention, is the aesthetic design wherein the partially removed lid nests within a recess on the top of the tubular member.

It is an object of the invention to provide a beverage container that has a greater dispensing capability.

It is another object of this invention to provide a beverage can having a semi-circular entire lid portion that can be partially removed and retained in a top recess thereof.

These and other objects of this invention will become clearer and more apparent with reference to the accompanying drawings and detailed discussion.

BRIEF DESCRIPTION OF THE DRAWINGS

A complete understanding of the present invention may be obtained by reference to the accompanying drawings, when taken in conjunction with the detailed description thereof and in which.

DESCRIPTION OF THE PREFERRED EMBODIMENT

Generally speaking, the invention features a beverage container having a greater dispensing area. The container has a fast beverage dispensing flow rate, by virtue of a bifurcated, semi-circular lid portion that is partially removed from the container, and which is subsequently retained in a top recess along the periphery of the container.

For the purposes of brevity, like elements will bear the same designation throughout the figures.

Figure 1:
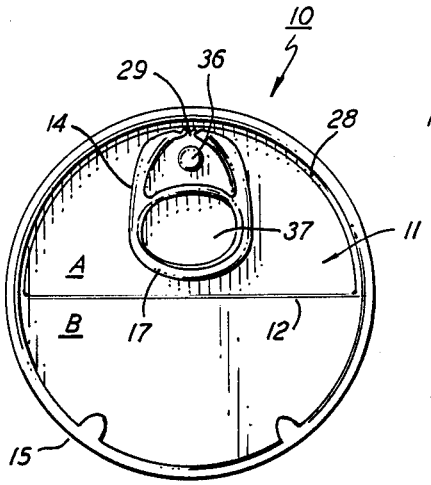
FIG. 1 is a top view of the beverage container of this invention.
Figure 2:
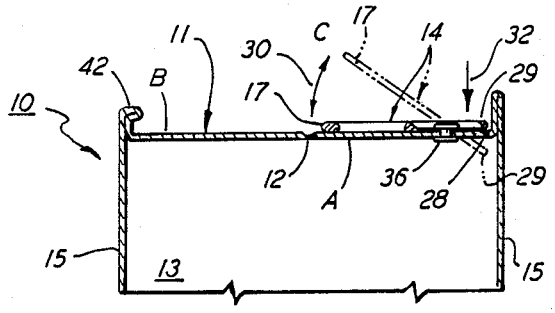
FIG. 2 is a partial sectional view of the beverage container of FIG. 1 showing in phantom an initial unsealing of the lid of the container.

Now referring to FIGS. 1 and 2, a beverage container (arrow 10) is shown having a bifurcated lid 11 which is dichotomized into two equal sections "A" and "B", respectively, about the demarcation line 12.

The beverage container comprises a thin walled, hollow, aluminum tube 15 (FIG. 2) which stores and dispenses the beverage.

A sealed opening in lid 11 is defined by the semi-circular scored line 28 which encircles the periphery of lid 11 to the demarcation line 12.

A tab 14 attached to section A of lid 11 is used to rupture the scored line 28.

When the finger grip end 17 of tab 14 is pulled upwardly (arrow 30), to phantom position "C", the tip 29 of tab 14 is caused to be depressed (arrow 32), thus rupturing the seal along score line 28, and forcing the tip 29 (shown in phantom) into interior cavity 13.

The downward movement of tip 29 is caused by the upward pull (arrow 30) of tab 14 by reason of the securing rivet 36. Securing rivet 36 attaches tab 14 to section A of the lid 11, and acts as fulcrum. Therefore, tip 29 pivots downwardly about rivet 36 when the tab 14 is pulled upwardly (arrow 30).

Figure 3:
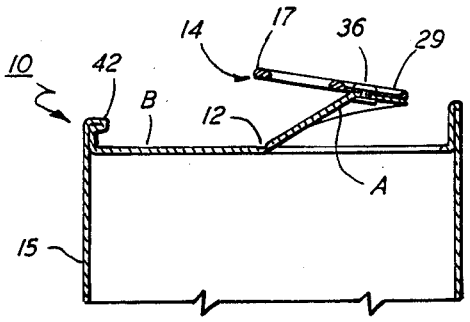
FIG. 3 is the sectional view of the invention shown in FIG. 2 with the full unsealing of the partially removable lid portion.

When tab 14 is subsequently pulled further upwardly by gripping tab 14 with a finger at grip end 17 through hole 37 (FIG. 3), section A of lid 11 is torn along the semicircular scored line 28 about the circumferential length, and upwardly partially removed from tube 15 until the demarcation line 12 is reached.

Thus, a large, smooth-edged, semi-circular opening 25 (FIG. 5) is provided in can 10, such that can 10 has a greater flow rate characteristic of a drinking glass.

Figure 5:
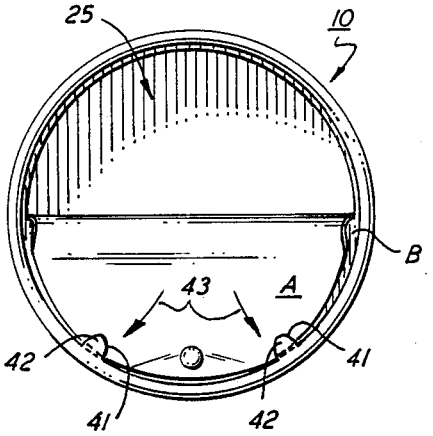
FIG. 5 is a top view of the retained lid in FIG. 4.
Figure 4:
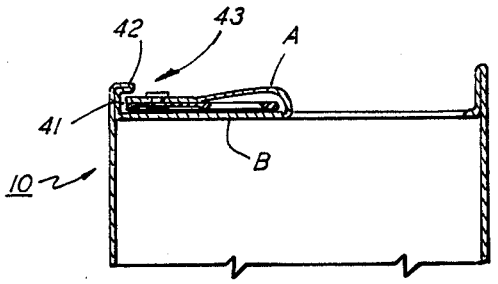
FIG. 4 is the sectional view of FIG. 2 illustrating the retention of the partially removable lid portion within a peripheral recess in the top of the container.

A recess 41 is placed in the top of section B of the container 10 in order to provide retention for the partially removed lid 11, illustrated in FIGS. 4 and 5.

Two protuberances 42 are equally spaced about the periphery of section B of tube 15, creating holding fingers for section A of lid 11, which is pressed into recess 41 (arrows 43), as shown.

Protuberances 42 provide a snap-action locking mechanism for lid retention.

Having thus described the invention, what is desired to be protected by Letters Patent is presented by the subsequently appended claims.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A beverage container comprising:

a hollow tubular member for storing and dispensing a beverage, said tubular member having a recess in a top portion thereof defined at its periphery by a circumferential wall, and projections extending therefrom for capturing and holding an unsealed portion of a lid;

a generally flat-surfaced, bifurcated lid disposed on top of said tubular member for sealing said beverage in said tubular member;

means defining a sealed opening including a substantially semi-circular score line disposed about a periphery of said lid comprising approximately one-half of a lid surface area, wherein said beverage is dispensable when said opening is unsealed with a greater facility by virtue of said lid being half open; and an opening means disposed upon said lid adjacent said sealed opening for unsealing said sealed opening by means of tearing said score line to access up to one-half of said lid surface area, whereby said beverage can be dispensed from said tubular member with a smooth flow rate.

2. The beverage container of claim 1, wherein said opening means include a pull tab for tearing the score line of said sealed opening.

3. A beverage container comprising:

a hollow tubular member for storing and dispensing a beverage, said hollow tubular member having a recess in a top portion thereof defined at its periphery by a circumferential wall and projections extending therefrom for capturing and holding a torn and bent lid portion;

a generally flat-surfaced, bifurcated lid disposed on top of said tubular member, said lid being bendable about a mid-portion of said tubular member by tearing said lid along a scored line disposed about a substantially semi-circular peripheral portion thereof; and a tab secured to said lid, said tab having a section thereof attached adjacent to said peripheral scored line, wherein said scored line will be caused to be ruptured upon an initial pull of said tab, and further wherein said substantially semi-circular lid portion will be bendably torn backwardly from said tubular member upon a further pull of said tab.

4. A beverage container for soda or beer beverage, comprising a tubular member for storing and dispensing said beverage, said tubular member having a lid having a substantially semi-circular removable sealed lid portion, and a pull tab for unsealing and tearing said lid portion from said tubular member, whereby approximately one-half of said lid is opened to access said beverage, and means defining a circumferential wall about said lid having projections for capturing and holding a torn and bent lid portion.

* * * * *